US010733811B2

(12) United States Patent
Martínez Alvaro et al.

(10) Patent No.: US 10,733,811 B2
(45) Date of Patent: Aug. 4, 2020

(54) SYSTEM AND METHOD FOR DETERMINING THE POSITION OF A CONTROL AREA

(71) Applicants: CINTRA INFRAESTRUCTURAS, S.A., Madrid (ES); GRUPO MECÁNICA DEL VUELO SISTEMAS, S.A.U., Madrid (ES)

(72) Inventors: Cristóbal Martínez Alvaro, Madrid (ES); Antonio García Fernández, Madrid (ES); Joaquín Cosmen Schortmann, Madrid (ES); Miguel Azaola Sáenz, Madrid (ES)

(73) Assignees: CINTRA INFRAESTRUCTURAS, S.A., Madrid (ES); GRUPO MECANICA DEL VUELO SISTEMAS, S.A.U., Madrid (ES)

( * ) Notice: Subject to any disclaimer, the term of this patent is extended or adjusted under 35 U.S.C. 154(b) by 174 days.

(21) Appl. No.: 15/958,682

(22) Filed: Apr. 20, 2018

(65) Prior Publication Data

US 2018/0240285 A1 Aug. 23, 2018

Related U.S. Application Data

(62) Division of application No. 14/432,674, filed as application No. PCT/ES2012/070693 on Oct. 4, 2012, now abandoned.

(51) Int. Cl.
*G07B 15/06* (2011.01)

(52) U.S. Cl.
CPC ..... *G07B 15/063* (2013.01); *G07B 15/06* (2013.01)

(58) Field of Classification Search
CPC ..... G07B 15/06
(Continued)

(56) References Cited

U.S. PATENT DOCUMENTS 5,715,389 A * 2/1998 Komori ..... G06F 11/0757 714/47.1
7,667,618 B2 2/2010 Chitor et al.
(Continued)

FOREIGN PATENT DOCUMENTS

| | | |
|---|---|---|
| EP | 1500907 | 1/2005 |
| EP | 1811480 | 7/2007 |
| WO | 2010020966 | 2/2010 |

OTHER PUBLICATIONS

Development of a GPS-based highway toll collection system published by Center for systems and machines intelligence, college of engineering (Year: 2016).*

*Primary Examiner* — Jeff Zimmerman
*Assistant Examiner* — Zeina Elchanti
(74) *Attorney, Agent, or Firm* — Ladas & Parry LLP

(57) ABSTRACT

The invention relates to a method for determining the position and shape of a control area on a road on which a vehicle is travelling, and to which a usage charge applies. According to the invention, a segment of the road is divided into segment sections and the perimeter of geographical coordinates of the control area associated with each segment section is calculated. At at least two different moments, a GNSS receiver calculates the position of the vehicle, said calculated positions being inside the control area; a control area being provided that is defined by a perimeter of geographical coordinates, fulfilling the requirements in terms of charging availability being above a pre-determined threshold value and the probability of a charging error being below a threshold value.

5 Claims, 2 Drawing Sheets

(58) Field of Classification Search
USPC ..... 705/13
See application file for complete search history.

(56) References Cited

U.S. PATENT DOCUMENTS

| | | | | |
|---|---|---|---|---|
| 8,456,274 | B2 | 6/2013 | Modiano | |
| 2009/0157566 | A1* | 6/2009 | Grush | G07B 15/02 705/400 |
| 2009/0234580 | A1* | 9/2009 | Fernandez-Hernandez | G01C 21/30 701/436 |
| 2011/0218896 | A1 | 9/2011 | Tonnon et al. | |
| 2015/0179009 | A1* | 6/2015 | Lykkja | G07C 9/00126 340/928 |

* cited by examiner

SYSTEM AND METHOD FOR DETERMINING THE POSITION OF A CONTROL AREA

CROSS REFERENCE APPLICATIONS

This application is a Divisional of U.S. patent application Ser. No. 14/432,674 filed Mar. 31, 2015, which is a 371 of International Application PCT/ES2012/070693 filed 4 Oct. 2012, the content which is incorporated herein by reference.

PURPOSE OF THE INVENTION

This invention refers to a system and method for optimal to determination of the position and shape of control areas used in an automatic process for transfer of geolocation data and generation of usage charges as a toll for the use of predetermined segments of road, in particular by motor vehicles travelling on predetermined segments of a road.

STATE OF THE ART

It is known in the state of the art that one possible manner of determining a usage charge for using a predetermined segment of a road is to check whether a vehicle is inside a given control area.

The usage charge is generated when the vehicle detects that it has passed through one or more control areas. The number, "m", of control areas which need to be detected to generate the usage charge can be defined for each system.

A set of "n" control areas can be defined in a predetermined segment of road where n≥m.

The detection of the vehicle's current location within a network of roads is performed by a geolocation receiver, i.e. a GNSS navigation receiver on board the vehicle itself, with the GNSS receiver built into an on-board unit which also includes a communications emitter-receiver which is responsible for transmitting to a usage application server either the location data associated with a current vehicle location resulting from this detection together with the identification data for the on-board unit associated in a one-to-one relationship with the user and, in turn, with the vehicle.

Once the geolocation data are received by the server, the latter determines whether the vehicle is travelling on a segment of road subject to a usage charge by identifying whether the vehicle has been inside the aforementioned "m" control areas. Alternatively, the on-hoard equipment itself can determine this and send the result of the check performed to the server, i.e. the usage charge is calculated in the on-board equipment.

In the first scenario, determination of the usage charge in the server, the method involves high data traffic in the usage charge generation system, between the on-board device and the usage charge server.

Given that the positioning system has errors, the above mentioned method does not guarantee correction in the determination process and, therefore, errors can occur when establishing whether a given vehicle is travelling on a predetermined segment to which a usage charge needs to be applied.

SUMMARY

This invention seeks to overcome the disadvantage set out above by means of a method for determining the position and shape of a control area as claimed in the claims.

One purpose of an embodiment is to supply a transaction application server configured to supply a set of "n" control areas associated with segments of road for which use involves the emission of a usage charge.

One aspect of the embodiment is to define the optimum position and shape of the set of n control areas that make it possible to ensure that the probability of the system charging the user and of it charging non-users in error comply with probabilities defined according to the needs of the different players.

Another aspect of the embodiment is to provide control areas with control area secant segment lengths in the direction of travel of a vehicle greater than or equal to the quotient between the maximum speed at which a vehicle can travel through the control area and the frequency at which a signal receiver associated with a global navigation satellite system calculates the current position of the vehicle travelling through the control area so as to guarantee that under nominal conditions there are at least two positions within that control area in the scenario in which the vehicle is travelling through the segment in question.

A further aspect of the embodiment is to provide a transaction application server configured to transmit a set of "n" control areas generated to a set of wireless telecommunications network user client devices.

Yet another aspect of the embodiment is to provide a transaction application server adapted to issuing a message to a barrier management system for a predetermined segment of road to which a usage charge applies, in order to open a barrier in the direction of travel of the vehicle travelling through the segment.

The method for determining the position and shape of a control area can be used in applications where it is necessary to obtain guaranteed, robust information that a vehicle has used or accessed a certain transport infrastructure of the automatic toll system type for motorways, roads, access to urban perimeters, car parking in delimited zones, urban congestion control, etc.

Yet a further purpose is to supply a system for determining the position and shape of closed control areas on a segment of road, to which a usage charge is applicable, if the same vehicle is detected in at least "m" of those control areas, defining a target probability $p_{md}$ of failure to generate usage charges for a segment user and a target probability $p_{fa}$ of generating usage charges for a vehicle travelling along a road other than the segment of road to which the usage charge applies; characterised in that the system comprises a transaction application server adapted to:

a Dividing the segment of road selected into "N" segment sections, with each segment section having an associated closed control area;

b Characterising the length of the N segment sections and the road half-width $a_i$ in the N segment sections;

c Characterising the topology of the segments of road outside the N segment sections of road;

d Characterising the GNSS errors inside of and around the N segment sections depending on the level of protection $PL_i(x)$ defining a curve of maximum GNSS error margins depending on the probability that a curve of margins is lower than the maximum margin curve;

e Identifying the probability $(p_{fa})_i$ of detecting a vehicle assuming that these are all equal and the probability $(p_{md})_i$ of failure to detect a vehicle also assuming that these are all equal and their values can be derived from probabilities $p_{md}$ and $p_{fa}$ according to a distribution of the binomial type:

$$p_{fa} = \sum_{j=1}^{m-1} \binom{m-1}{j} (1 - p_{fa_i})^j p_{fa_i}^{m-1-j}$$

$$p_{md} = \sum_{j=m}^{n} \binom{n}{j} (1 - p_{md_i})^j p_{md_i}^{n-j}$$

f Defining a minimum closed control area length positioned in the centre of the segment section to guarantee that, under nominal conditions, there are at least two positions inside the control area, with the length greater than 2V/f, where V is the speed at which the vehicle travels and f is the frequency of refreshing the position calculation by means of a GNSS receiver;

g Estimating a minimum distance $u_i$ between the perimeter edge of the closed control area and any road outside that control area on which a vehicle can travel to ensure that the probability $(p_{fa})_i$ is lower than or equal to the maximum probability threshold value $(p_{fa})_i$ for detecting a vehicle travelling along a segment of a road other than the segment of road to which a usage charge is applicable; where the distance $u_i$ corresponds to the value of the $PL_i(x)$ curve for a probability equal to $1-(p_{fa})_i$;

h Estimating a minimum distance $d_i$ between the potential positions of the user inside the control area and the edges of the same area to ensure that the probability of failure to detect a vehicle travelling on the segment is less than or equal to $(p_{md})_i$; where the distance $d_i$ corresponds to the value of the $PL_i(x)$ curve for a probability value equal to $1-(p_{md})_i$;

i Defining the shape of the closed control area that complies with:

length greater than 2V/f;

distance $d_i$ less than or equal to the shortest distance from the point furthest from the edge of the two points guaranteed to be inside the area under the previous condition;

the Minkowski sum of the control area and a circle of radius $u_i$ which does not intersect with the zone covering the possible places through which a vehicle can travel outside the segment of road to which a usage charge is applicable;

j Selecting "M" possible closed control areas which fulfil the inequations in absence of intersections between control areas; where N≥M≥n;

k Supplying a subset "n" of closed control areas of the M possible control areas to a plurality of client devices that can be installed onboard vehicles.

BRIEF DESCRIPTION OF THE FIGURES

A more detailed explanation of the invention is given in the following description based on the attached figures.

DESCRIPTION OF AN EMBODIMENT

Described below is a method for optimal determination of the position and shape of a control area on a predetermined segment of road, which is used in an automatic process for transferring geolocation data and generating usage charges, as a toll for the use of a predetermined segment of road by motor vehicles travelling on the predetermined segment of road. A vehicle is a user of the segment of road if and only if it is travelling on that segment.

A control area is a closed area delimited by a perimeter of geographical coordinates, geographically referenced within a map of geographical information used to identify when a vehicle is using the predetermined segment of road.

The control area can be of any shape. The process of positioning and delimiting the perimeter of the simplest control area is a circular control area where it is only necessary to define the position of the centre and the radius of the control area.

A control area delimited by a perimeter of geographical coordinates must be such as to ensure a probability of detecting the user higher than a predetermined threshold value and a probability of incorrect detection, for a vehicle not travelling along the segment to which a usage charge applies, lower than another different threshold value.

The combination of these probabilities for a number "m" of control areas for a set of "n" traffic areas supplied for each segment, where m<n, determines the probability of charging a user which has travelled on the segment of road to which a usage charge applies, also known as charging availability, and the probability of incorrectly charging non-user vehicles which have not travelled on the segment of road to which a usage charge applies.

The charging availability parameter must be such that a high percentage of users generate a usage charge; and the probability of incorrect charging parameter must be such that a small percentage of non-users generate a usage charge in error.

Therefore, the probability of incorrect charging is minimised the higher the value of "m" and the lower the value of "n−m", whilst the availability parameter has the opposite behaviour.

The method for automatic determination of the position and shape of at least one control area comprises the steps of selecting a predetermined segment of road to which a usage charge applies; segmenting the selected segment into a set of "N" segment sections; and, for each of the section segments, identifying an associated control area.

Figure 1:
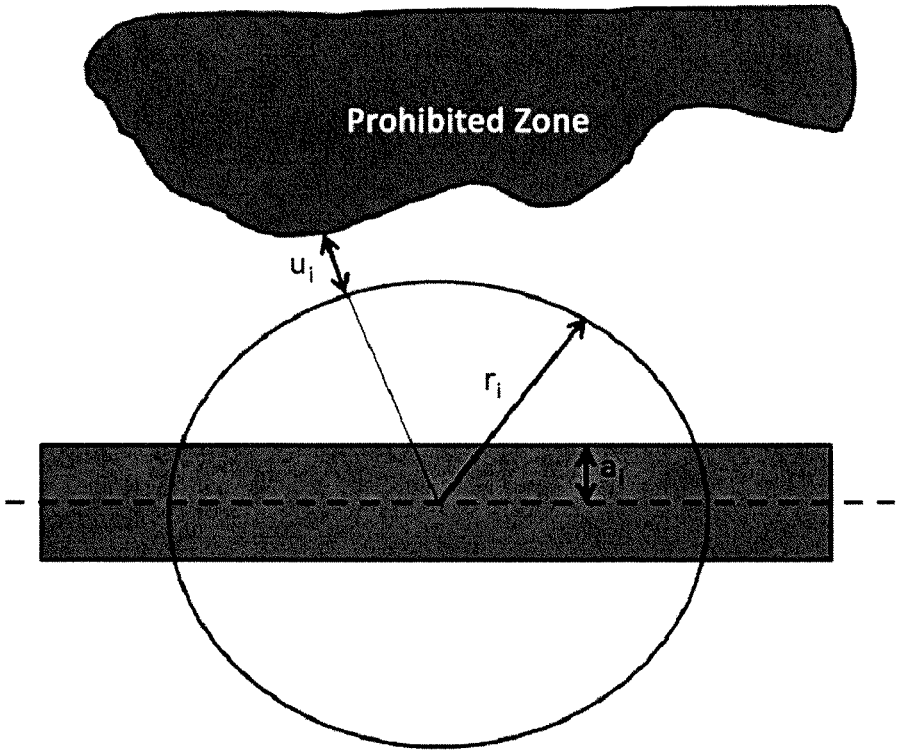
FIG. 1 shows the position and parameters characteristic of the shape of a control area, of the set of control areas, associated with a section of a predetermined segment of road.
Figure 3:
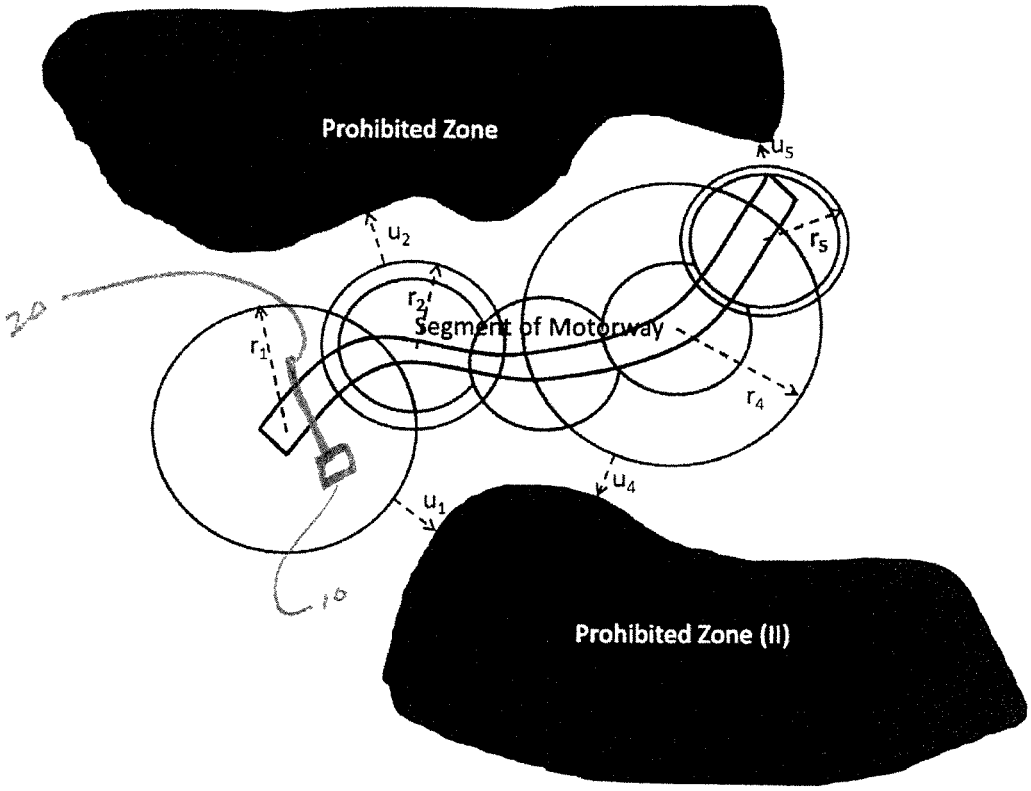
FIG. 3 shows a set of "n" control areas defined on the segment of road to which a usage charge applies and zones neighbouring the road to which a usage charge applies, namely prohibited zones where a vehicle not using that segment may be located and for which an usage charge may be generated due to potential system error.

In a scenario in which the control area is a circle, its radius $r_i$, must guarantee that at least two different moments, a GNSS receiver calculates the position of the vehicle within the control area defined. Therefore, the radius of the control area must satisfy $r_i$>V/f, where V is the speed of the vehicle and f is the frequency at which the GNSS receiver calculates the position of the vehicle. The centre of the control area is assumed to be on the axis of the road to which a usage charge applies. Similarly, the road half-width $a_i$ is known. Also calculated is the shortest distance $u_i$ between the edge of the control area perimeter and any road outside that control area where a vehicle can travel, i.e. the maximum permitted value of $u_i$, see FIG. 1. FIG. 3 shows a segment of a roadway having a plurality of control areas with radii $r_1$, $r_2$, $r_4$, and $r_5$ and having distances $u_1$, $u_2$, $u_4$ and $u_5$ from portions of the roadway to prohibited zones to which a vehicle can travel. A predetermined part of the roadway has a barrier management system 10 with a barrier 20 that can be opened upon receiving a message from the transaction application server.

Figure 2:
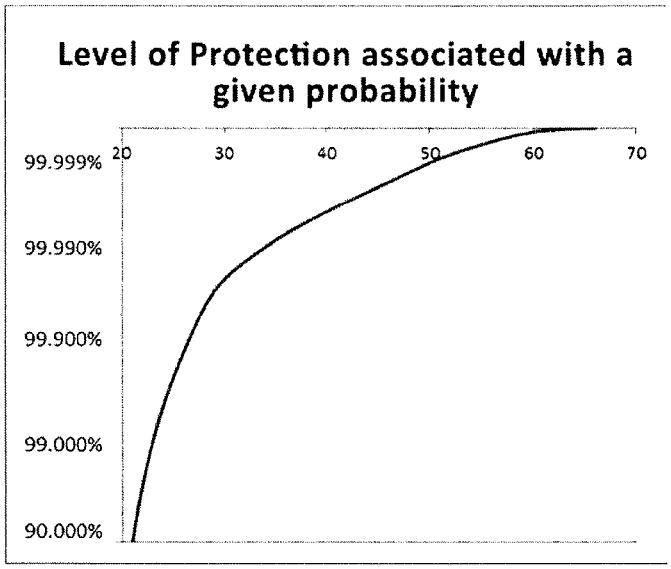
FIG. 2 shows a graph of the level of protection, i.e. a guaranteed margin of error associated with a probability for a given geographical area, where a level is defined for each probability to ensure that the error is lower than that margin with that probability.

The errors deriving from Global Navigation Satellite System (GNSS), signals are characterised by the margin of geographical position error for a given probability, namely the level of protection according to the $PL_i(x)$ curve, see FIG. 2. This margin of error can depend on the radio frequency environment of each segment section, therefore a different environment is assumed for each control area, considering all the possible geographical vehicle positions inside the control area and neighbouring the same area. The level of protection value is estimated for each control area as the worst value within that control area and its surroundings. The control area environment can be defined by increasing the value of the radius $r_i$ with a value which is a function of the distance $u_i$, for example, a value can be $10u_i$ and can be estimated both from field measurements and based on theoretical models.

The method for automatic determination of the position and shape of control areas on a predetermined segment of road takes the following parameters into account in the stage of calculating the control area in a segment section: topology of the segment of road to which a usage charge applies; topology of roads outside the segment of road to which a usage charge applies; maximum speed at which vehicles can travel along the segment of road to which a usage charge applies; errors in the location system, i.e. the distance between the real and estimated position, which in turn is a function of the physical and radio frequency environment in the neighbourhood of a control area; frequency of GNSS position updating; and errors in the cartography or map including the segment of road to which a usage charge applies.

In a scenario where the control area is a closed line in the shape of a circle, it can be guaranteed with the considerations stated above, that the minimum distance between a geographical position of the vehicle travelling inside the control area and the edge of the perimeter of the same control area is:

$$d_i \geq r_i - \sqrt{((r_i/2)^2 + a_i^2)}$$

For each control area, identified by the suffix i, the probability of failure to detect a vehicle travelling inside it is defined as a probability $(p_{md})_i$ and the probability of detecting a vehicle outside of the infrastructure is defined as a probability $(p_{fa})_i$. Both probabilities must be close to 0. The overall probability of failure to generate a usage charge for a vehicle $p_{md}$ is calculated as the probability of detecting less than m of the n control areas calculated based on the probabilities associated with each control area.

At the same time, the probability of false generation of a usage charge $p_{fa}$ is calculated as the probability of at least m false detections occurring.

If it is assumed that the overall probability of failure to generate a detection for a vehicle $(p_{md})_i$ is equal in all the control areas and the probability of false generation of a detection $(p_{fa})_i$ for each control area of each segment section is also equal in all the control areas, the overall probabilities associated with the detections is calculated based on the binomial distribution such that:

$$p_{fa} = \sum_{j=1}^{m-1} \binom{m-1}{j} (1 - p_{fa_i})^j p_{fa_i}^{m-1-j}$$

$$p_{md} = \sum_{j=m}^{n} \binom{n}{j} (1 - p_{md_i})^j p_{md_i}^{n-j}$$

Based on the requirements for probability $p_{md}$ of failure to generate a usage charge and probability $p_{fa}$ of false generation of a usage charge and assuming that the probabilities for each of the control areas, $p_{md\text{-}i}$ and $p_{fa\text{-}i}$, are equal for a pair of elements in and n, defined beforehand or entered in an iterative process, values of $(p_{md})_i$ and $(p_{fa})_i$ which satisfy the above inequations are calculated.

Given $(p_{md})_i$ and based on the $PL(x)_i$ curve for the probability $1-(p_{md})_i$, a minimum margin is estimated for the value of $d_i$; and given $(p_{fa})_i$ and based on the $PL(x)_i$ curve for the probability $1-(p_{fa})_i$, a minimum margin is estimated for the value $u_i$.

With the values for parameters $u_i$ and $d_i$ and, from the latter, the value of $r_i$, checking that the value of $r_i$ is compatible with the network topology. A control area associated with a segment section is discarded in case of failure to comply with any of the restrictions established. M control areas will be valid from this process ($M \leq N$).

From the control areas selected making the combinations of M over n, a subset M of control areas will be selected which minimises a predefined cost function. That cost function will need to maximise a linear combination of the sum of the $u_i$ y $r_i$ values.

The use of the optimal method for determining the position and shape of control areas on a predetermined segment of road requires cooperation from a radio telecommunications network over a network of roads; a global navigation satellite system (GNSS); a client device that can be mounted on board, for example, a portable telephonic system device assigned in a one-to-one relationship to a predetermined user of a motor vehicle, that communicates by radio with a telecommunications network access node and comprises a satellite navigation receiver, namely a GNSS receiver; a transaction application server that supplies at least one control area for a defined segment of road to a plurality of client devices over communications channels established over the telecommunications network; and a cartographic application server that communicates with the transaction application server and the client devices over the same telecommunications network.

The GIS-type information server supplies cartography for selecting the segment sections which will have a control area associated, according to the aforementioned method for determining the position and shape of the control areas.

The transaction server is adapted to estimating the levels of protection of the segment sections by means of the receipt of the results of performing in situ measurements of levels of protection by means of vehicles travelling on road segment sections and/or modelling the environment of each segment section and of the GNSS constellation based on simulators of the "service volume" type used for GNSS performance analysis.

The geographical information system supplies information of the topological type for road segments, including their centre and width, information relating to all the roads, distances between different roads, maximum speeds, etc.

The transaction server uses the information from the geographical information system to supply control areas with their position and shape.

The transaction server supplies control areas with shapes of the closed polygonal line, circular, semicircular or elliptical type, or a combination of several of these; although a control area with a circular shape is defined with a smaller number of geolocation identification data.

The transaction server guarantees that a usage charge is issued when there is a predetermined number of coincidences of geographical coordinates associated with a vehicle travelling on a predetermined segment of road.

Once the transaction server has generated a set of control areas, it transmits the identification data, which characterise these control areas, by means of a radiocommunications module to the plurality of client devices, such that the identification data for the control areas are received by means of the corresponding radiocommunications modules and stored in storage units included in the client devices.

The invention claimed is:

1. A method for automatic charging for usage of a segment of a road by a vehicle associated with an on-board signal receiver, including a Global Navigation Satellite System (GNSS) receiver, which is travelling on the segment of road; the method comprising: providing, by a transaction application server, the segment of road into "N" segment sections, with each segment section having an associated closed control area, transmitting, by the transaction application server, to the on-board signal receiver of the vehicle travelling on the segment of road, a set of "n" control areas for the segment of road, detecting, by the Global Navigation System (GNSS) receiver, the vehicle on the segment of road and transmitting, by the transaction application server to a barrier management system, a message to open a barrier of the segment of the road in at least "m" of the control areas to cause the barrier management system to open the barrier, wherein $m<n$; and applying, by the transaction application server, a usage charge to the vehicle detected on the segment of road;

further comprising providing the "n" control areas with control area secant segment lengths in a direction of travel of the vehicle that are greater than or equal to a quotient between a maximum speed at which the vehicle can travel through each of the control areas and a frequency at which the GNSS receiver calculates a current position of the vehicle within each of the control areas.

2. The method of claim 1, further comprising connecting the on-board signal receiver to the transaction application server over communications channels established over a telecommunications network.

3. The method of claim 2, further comprising connecting the geographical information to the transaction application server over communications channels established over the telecommunications network.

4. The method of claim 1, further comprising providing, by a geographical information server to the transaction application server, information of a the topological type for each of a plurality of segments of other roads, including information relating to each of the other roads, distances between the other roads, maximum speeds, for supplying a position and shape of respective control areas associated with the plurality of segments of the other roads.

5. The method of claim 1, further comprising identifying when a vehicle is using one of the "n" control areas.

* * * * *